US005116059A

United States Patent [19]

Pelletier

[11] Patent Number: 5,116,059

[45] Date of Patent: May 26, 1992

[54] GOLF PRACTICE APPARATUS

[76] Inventor: Robert A. Pelletier, 657 Rock Springs Rd., Kingsport, Tenn. 37664

[21] Appl. No.: 759,872

[22] Filed: Sep. 13, 1991

[51] Int. Cl.[5] ..... A63B 69/36

[52] U.S. Cl. ..... 273/200 A

[58] Field of Search ..... 273/184 B, 185 C, 185 D, 273/191 A, 196, 198, 200 R, 200 A, 200 B, 58 C, 26 EA

[56] References Cited

U.S. PATENT DOCUMENTS

| | | | |
|---|---|---|---|
| 1,504,752 | 8/1924 | Green | 273/198 |
| 3,754,761 | 8/1973 | Pruss | 273/200 A |
| 4,071,250 | 1/1978 | Vroome | 273/198 X |
| 4,095,798 | 6/1978 | Marple | 273/185 C X |
| 4,662,639 | 5/1987 | Bonotto | 273/200 R X |
| 4,944,513 | 7/1990 | Zenter | 273/26 EA X |
| 5,011,155 | 4/1991 | Udomkesmalee et al. | 273/200 A |

FOREIGN PATENT DOCUMENTS

| | | | |
|---|---|---|---|
| 16765 | 3/1934 | Australia | 273/200 R |
| 466691 | 9/1936 | United Kingdom | 273/260 R |
| 2072518 | 10/1981 | United Kingdom | 273/26 EA |

*Primary Examiner*—William H. Grieb
*Assistant Examiner*—William E. Stoll
*Attorney, Agent, or Firm*—Phillips & Beumer

[57] ABSTRACT

Apparatus for a backyard golf practice range including a stake with an enclosed aperture that allows a looped cord to slide until the end of the cord loop is reached. A cold processed monofilament nylon cord, a golf ball with a bore allowing the ball to slide over the cord, and a keeper plate for securing the cord ends together to form a loop are also included. The keeper plate has two sets of three holes each through which the cord ends are threaded in a prescribed manner to provide a secure connection. The required structure for the golf ball and suitable cord and bore sizes are also given.

8 Claims, 2 Drawing Sheets

GOLF PRACTICE APPARATUS

FIELD OF THE INVENTION

This invention relates generally to golf equipment and more particularly to golf driving practice equipment using a tethered ball.

BACKGROUND OF THE INVENTION

A need exists for golf practice equipment which would enable a golfer to practice driving in an area of limited space such as a back yard. Various types of equipment for this purpose are available, for example, nets against which a ball may be driven and devices wherein a golf ball is permanently attached to the end of a rod which rotates upon striking the ball. These devices present disadvantages in their lack of realism and/or their failure to enable flight pattern detection.

One approach to a backyard driving range would be to secure a golf ball to a cord or string that is restrained by being connected to a stake in the ground. Upon driving the ball from the tee, the string tightens, causing the ball to rebound back to or behind the tee. While simple in concept, this approach has proven difficult to implement in several respects. A high degree of durability in the cord is required owing to forces generated when the ball is struck. At the same time, the cord should be light in weight to provide maximum realism. In addition, the cord should not become coiled or entangled during rebound, and many types of cords are not suitable in this respect. Another problem is to provide an effective means for tying the cord which is particularly difficult for a monofilament nylon cord that is best suited to meet other requirements. The obvious expedient of tying cord ends together by forming a knot has not proven effective for the type of cord which is preferred for reasons stated above. A stake that is effective for use in various types of soil and a golf ball having an internal structure that will enable it to slide over the cord are also required for use in the present invention. Available golf practice equipment fails to meet one or more of these requirements.

SUMMARY OF THE INVENTION

The present invention is directed to backyard golf driving range equipment including a stake having an enclosed aperture through which a cord may slide, a cord in the form of an elongated loop, a keeper plate of a specified construction for tying the cord ends together, and a golf ball provided with a bore for receiving cord in a manner such that the ball will readily slide over the cord. In operation, the stake is placed at the middle of the length of a selected range, and a tee is placed near its rear end at a point where the loop cord is fully extended. Upon being driven, the ball moves forward past the stake until the cord tightens and the ball rebounds, sliding over the cord to the end point of the loop, bringing it back to the tee.

The invention provides a high degree of realism in that the ball is in essentially free flight until the end of the cord is reached. This enables early flight pattern detection. Difficulties associated with coiling or entanglement of the cord are avoided, and an effective means for tying the cord is provided.

DESCRIPTION OF THE PREFERRED EMBODIMENT

Figure 1:
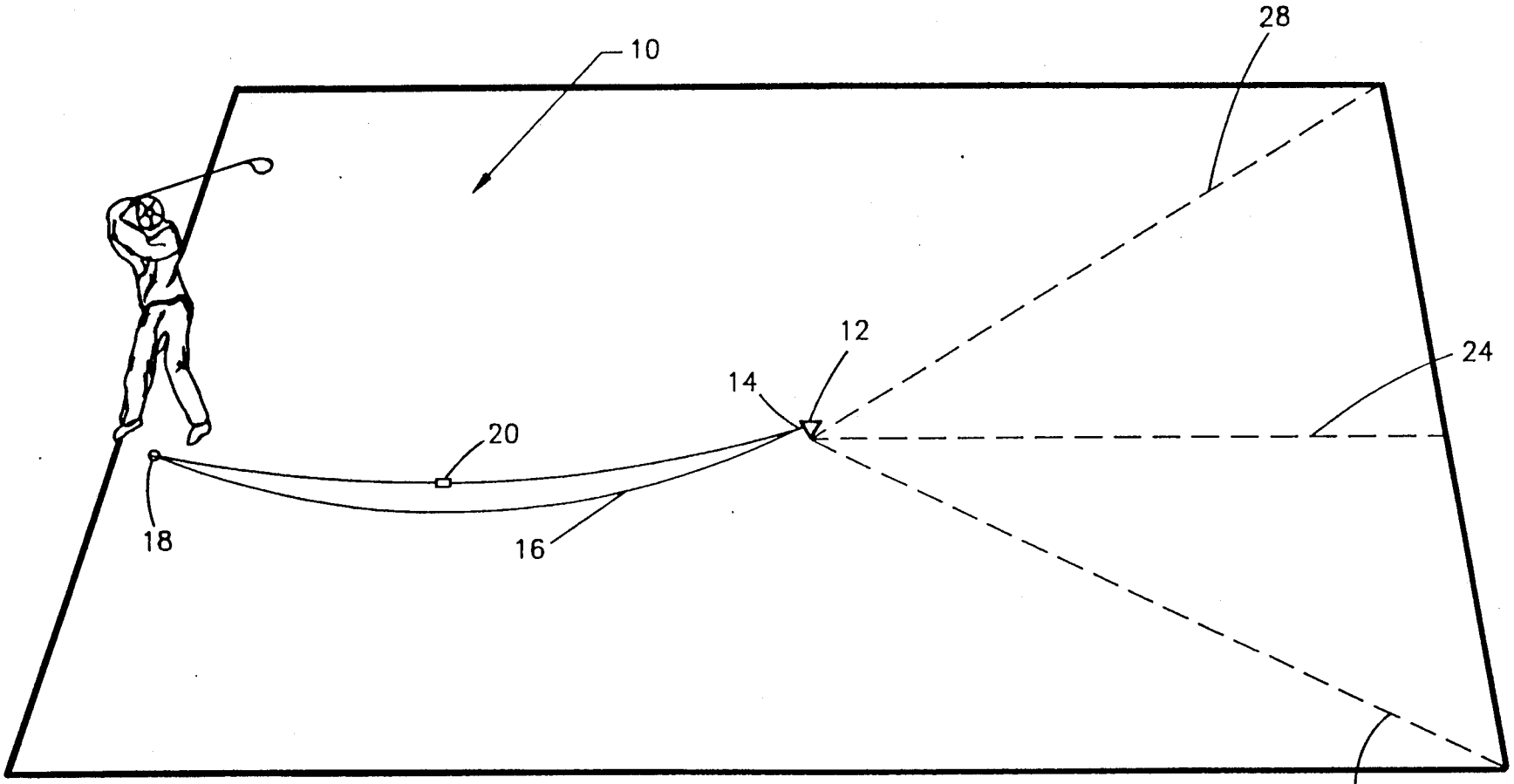
FIG. 1 is pictorial view showing equipment embodying the invention installed in a backyard driving range.

Referring to FIG. 1 of the drawings, there is shown a backyard driving range 10 with equipment embodying the invention installed. The equipment includes a stake 12 having an opening 14 through which a cord 16 is looped, the opening allowing the ball to slide freely over the cord. The cord is looped through the stake and through a golf ball 18 that has a bore 38 slightly larger than the diameter of the cord so as to enable the ball to slide over the cord. The ball is placed on a tee (not shown) for driving. Ends of the looped cord are secured together by being threaded in a prescribed manner on a keeper plate 20. The range may comprise an area 60 feet long by 20 feet wide, with the stake placed at the middle of the range. The length of the range should be twice the length of the looped cord. Flight patterns of driven balls may be recognized by observing whether the ball moves in a straight line as shown by line 24 or at an angle within areas defined by lines 26 and 28.

The diameter and material used for the cord are selected to provide high strength, consistent with minimum interference with flight of the ball and to avoid coiling or entanglement upon rebound. Monofilament lines that do not retain a "memory" may be used. In particular, cold processed nylon line is preferred. Hot processed lines such as are used for string trimmers are not suitable because of the tendency to become coiled and entangled when tension is released. A cord having a diameter of 0.050 to 0.075 inch may be used, with a diameter of 0.065 inch being preferred. Cords of a larger diameter such as 0.080 inch may noticably interfere with flight of the ball and thus detract from realism.

Figure 2:
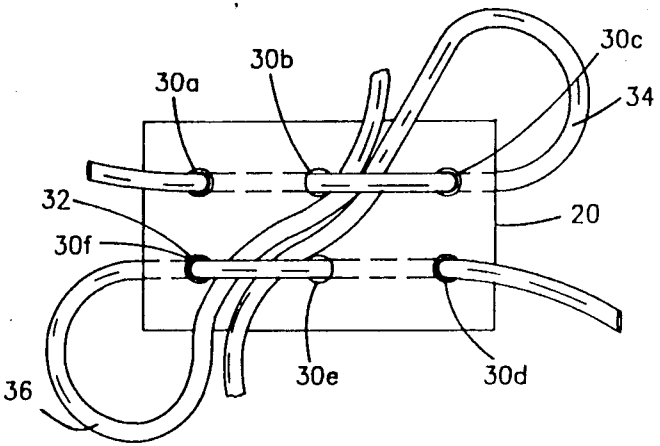
FIG. 2 is a planar view from above showing a keeper plate with cord ends secured thereon.

As shown in FIG. 2, tying of the cord ends together is carried out by use of a keeper plate 20. The keeper plate may comprise a rectangular piece of polypropylene, having a thickness of 0.125 inch. The plate has six holes 30*a*–30*f* through which the cord ends are threaded in a prescribed manner. Corner holes 30*a*, 30*c*, 30*d*, and 30*f* on each side preferably have a countersunk portion 32 to avoid presenting a sharp edge that might damage the cord. Cord end portion 34 is threaded sequentially downward through holes 30*a*, upward through hole 30*b*, and downward through hole 30*c*, and cord end portion 36 is similarly threaded downward through hole 30*d*, upward through hole 30*e*, and downward through hole 30*f*. Each of the cord ends is also threaded underneath itself between holes 30*b*, 30*c* and 30*e* and 30*f*, respectively, and across and under the other cord between the same holes. This provides a uniquely secure connection as contrasted with knots and keepers having a fewer number of holes, which have been found to be ineffective.

Figure 3:
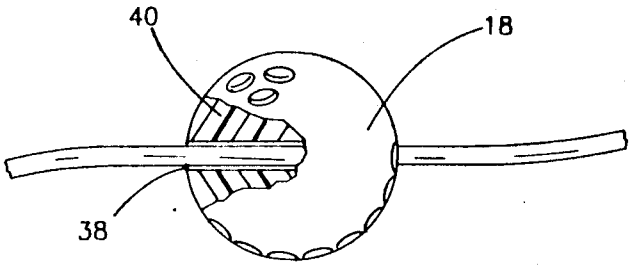
FIG. 3 is a planar view, partially broken away, showing a golf ball mounted on a cord.
Figure 4:
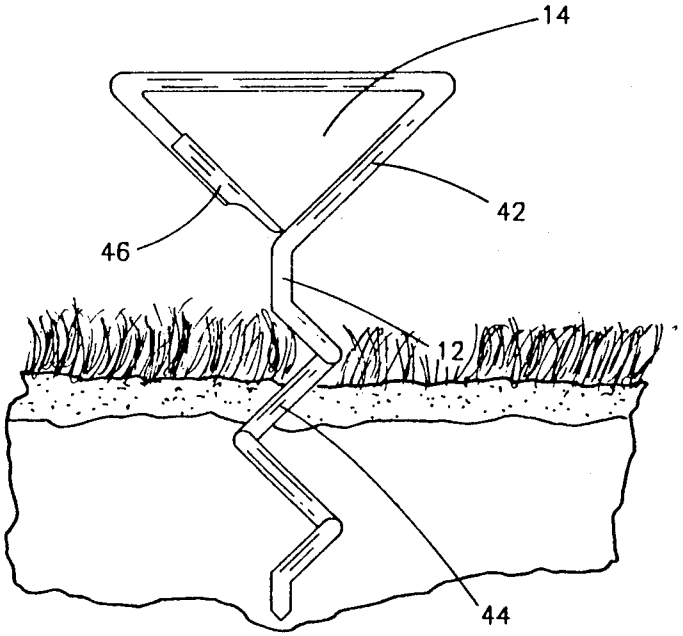
FIG. 4 is a planar view showing a restraining stake secured in the ground.

The golf ball 18 as shown in FIG. 3 has a bore 38 extending through its center with a diameter slightly larger than the cord diameter to allow the ball to slide freely. A clearance of 0.030 inch between the cord and bore is suitable for this purpose. A golf ball with a rigid solid core 40 is required inasmuch as balls of other construction such as a string-wound core would interfere with the required sliding action. Golf balls available under the designation Spalding 2 TM may be used.

Stake 12 has an opening 14 at its top defined by triangular bent-over rod 42 and a corkscrew base 44 for being screwed into the ground. A snap-on plastic clip 46 engages the end portion of rod 42 to close a gap adjacent to the end of the rod, this gap resulting from the manufacturing process by which such stakes are produced. The clip prevents the cord from falling down through the gap and onto the ground. This type of stake is preferred for its capability for use in all types of soil. Other types of stakes with an opening to allow the cord to slide through may also be used.

While the invention is described above in terms of a specific embodiment, it is not to be understood as limited thereto but is limited only a indicated by the appended claims.

I claim:

1. A golf practice apparatus comprising in combination:

a golf ball having a bore extending through the center thereof, the core of the ball adjacent to said bore comprising a body of rigid solid material;

a cord made of cold processed monofilament material, said cord being threaded through said bore and having its first and second ends secured together, forming a loop on which the ball is slidably mounted;

a keeper plate having two sets of at least three holes each extending therethrough for threading said cord into position such as to secure said ends together; and a stake connectable to the ground and having an enclosed aperture through which said cord may be threaded for slidable movement therethrough.

2. Golf practice apparatus as defined in claim 1 wherein said cord is made of cold processed monofilament nylon.

3. Golf practice apparatus as defined in claim 2 wherein said cord has a diameter of 0.050 to 0.075 inch.

4. Golf practice apparatus as defined in claim 3 wherein the diameter of said cord is selected to provide a gap of 0.030 to 0.050 inch between the cord and bore.

5. Golf practice apparatus as defined in claim 1 wherein said keeper plate has six holes disposed in two aligned rows of three holes per row.

6. Golf practice apparatus as defined in claim 5 wherein the four holes at the ends of each of said row are countersunk on each side of the plate.

7. Golf practice apparatus as defined in claim 5 wherein said plate comprises a thin, generally rectangular piece of polypropylene.

8. Golf practice apparatus as defined in claim 1 wherein said stake comprises a metal rod having a top end and a bottom end, the top end providing a loop defining an aperture, and the bottom end being formed into a corkscrew for engaging the ground.

* * * * *